US005133405A

United States Patent [19]

Elliston

[11] Patent Number: 5,133,405

[45] Date of Patent: Jul. 28, 1992

[54] COIL TUBING INJECTOR UNIT

[76] Inventor: Tom Elliston, 1401 Westover La., Fort Worth, Tex. 76107

[21] Appl. No.: 704,321

[22] Filed: May 23, 1991

[51] Int. Cl.[5] ..... E21B 19/22

[52] U.S. Cl. ..... 166/77; 166/85

[58] Field of Search ..... 166/77, 77.5, 85; 175/78; 83/13

[56] References Cited

U.S. PATENT DOCUMENTS

| | | | |
|---|---|---|---|
| 3,116,793 | 1/1964 | McStravick | 166/77 |
| 3,285,485 | 11/1966 | Slator | 166/77 |
| 3,363,880 | 1/1968 | Blagg | 166/77 |
| 3,559,905 | 2/1971 | Polynchuk | 166/77 X |
| 4,585,061 | 4/1986 | Lyons et al. | 166/85 X |
| 4,655,291 | 4/1987 | Cox | 166/77.5 X |
| 4,673,035 | 6/1987 | Gipson | 166/77 |
| 4,974,686 | 12/1990 | Hisey et al. | 166/77.5 X |
| 5,002,130 | 3/1991 | Laky | 166/77 |

*Primary Examiner*—Thuy M. Bui
*Assistant Examiner*—Frank S. Tsay
*Attorney, Agent, or Firm*—Charles D. Gunter, Jr.

[57] ABSTRACT

A coil tubing injector unit is shown for injecting tubing into a well bore. A main injector frame is positioned adjacent the well bore and includes a longitudinal opening which defines a vertical run for the injector unit which is alignable with the well bore vertical axis. Gripper block assemblies are carried on the main injector frame and include plier-like halves which are pivotable between an open position and a closed, gripping position as the assemblies enter the vertical run so that the plier halves grip a selected length of tubing fed into the main injector frame along the central vertical axis of the injector unit to inject the tubing into the well bore. A drive mechanism including a chain drive located on the main injector frame drives the gripper block assemblies in a continuous loop within the main injector frame.

12 Claims, 5 Drawing Sheets

COIL TUBING INJECTOR UNIT

BACKGROUND OF THE INVENTION

1. Field of the Invention

The present invention relates generally to devices for operating on wells, such as in workover operations. More specifically, the present invention relates to coiled tubing systems for injecting and extracting continuous lengths of tubing into and out of wells in various well servicing operations.

2Description of the Prior Art

Various tubing systems are shown in the prior art for working on wells. Generally speaking, a continuous metal tubing is driven down the well bore by means of an injector head. In the prior art devices, a pair of continuous-chain tube gripping assemblies were motor driven in the injector head to grip the tubing and move it down the well bore. Reverse operation of the gripping assemblies was used to withdraw the tubing string from the well bore. At the surface, the tubing was stored on a large drum or reel from which the tubing was withdrawn by the pull of the injector head. The reel was motor driven to rewind the tubing as it was withdrawn from the well.

The prior art coiled tubing systems utilized opposing chain designs in which a plurality of gripper members were carried by the opposing chains, the grippers being frictionally driven to engage a selected length of tubing for injecting the tubing with the well bore.

The prior art designs suffered from a number of disadvantages. The opposing chain drive design could not be easily removed from the selected length of tubing being inserted within the well bore if problems occurred during the well working operation. As a result, it was usually necessary to cut the tubing at the well surface with the result being a weakened section of the tubing string. The opposing chain drive designs satisfactorily gripped smaller diameter tubing such as one inch tubing but were not well adapted for gripping larger diameter tubing. The prior art systems also required a large number of working parts which increased maintenance and operating costs. Because the opposing grippers were formed with jaw openings of fixed diameter, it was not easy to retrofit the injector head for a different size diameter of coil tubing in the field. It was also difficult to prevent wear to high dollar component parts of the prior art devices such as the fixed diameter grippers.

A need exists for an improved coil tubing injector unit which would accommodate larger diameter tubing and which could be readily refitted in the field to accommodate a variety of tubing sizes.

A need also exists for such an injector unit which would feature fewer moving parts and lower maintenance costs as compared to currently available units.

A need also exists for such an improved injector unit which would feature an open face design to allow the unit to be easily removed from a string of tubing being injected into a well should the need arise.

SUMMARY OF THE INVENTION

The coil tubing unit of the invention is used to inject tubing into a well bore having a vertical well axis. The coil tubing injector unit includes a main injector frame which is positionable adjacent the well bore. The main injector frame has a top, a bottom and opposing vertical sides, a selected one of the opposing vertical sides having a longitudinal opening formed therein which defines a vertical run for the injector unit. The vertical run defines a central vertical axis for the injector unit which is alignable with the well bore vertical axis. A plurality of gripper block assemblies are carried on the main injector frame, each of the gripper block assemblies including a pair of plier-like halves which are pivotable between an open position and a closed, gripping position as the assemblies enter the vertical run, whereby the plier halves grip a selected length of tubing fed into the main injector frame along the central vertical axis of the injector unit in order to inject the tubing into the well bore. Drive means located on the main injector frame drive the gripper block assemblies within the main injector frame.

Preferably, the drive means is a chain drive which includes a drive sprocket and an associated chain. Gripper block assemblies are carried on the chain as the chain moves in a continuous loop between the drive sprocket and a cooperating idler sprocket. The vertical run defines an open face for the coil tubing injector unit. The open face is adapted to receive a length of vertically oriented coil tubing which is fed along the well vertical axis by moving the main injector frame in a direction transverse to the well vertical axis when the gripper block assemblies are in the open position.

The plier-like halves of the gripper block assemblies together form a jaw opening of predetermined size for gripping a selected length of coil tubing. Each of the plier-like halves includes a replaceable wear insert for varying the size of the jaw opening, whereby a variety of sizes of coil tubing can be injected into the well bore by interchanging the replaceable inserts.

A clamping assembly is mounted on the main injector frame. The clamping assembly includes first and second vertical rails which are spaced a selected distance within the clamping assembly for frictionally engaging the gripper block assemblies to either urge the gripper block assemblies closer together or farther apart. One or more C-shaped clamps are provided as a part of the clamping assembly which are movable between a disengaged position with respect to the coil tubing being fed within the vertical run and an engaged position in which the vertical rails contact the plier-like halves of the gripper block assemblies to pivot the gripper blocks to the closed, gripping position.

The clamping assembly preferably further includes adjustment means for varying the distance between the vertical rails to vary the degree of frictional engagement of the gripper block assemblies on the length of coil tubing being injected into the well bore. The adjustment means can comprise at least one hydraulic cylinder having an output shaft, a selected one of the cylinder and output shaft being operatively engaged between the main injector frame and at least one of the vertical rails of the clamping assembly for varying the distance between the vertical rails.

A spreader plate can be provided on the main injector frame in alignment with the vertical run for pivoting the plier-like halves of the gripper block assemblies to the open position prior to entering the vertical run.

In the method for injecting coil tubing of the invention, the main injector frame is positioned adjacent the well bore with the central vertical axis of the frame aligned with the well vertical axis. A continuous length of coil tubing is then fed along the central vertical axis and is gripped by the gripper block assemblies to inject the tubing into the well bore. The tubing can be retrieved by reversing the direction of the chain drive.

By moving the C-shaped clamps to the disengaged position and by moving the plier-like halves of the gripper block assemblies to the open position, the coil tubing injection unit can be removed from the continuous length of tubing by sliding the unit in a direction transverse to the well vertical axis, allowing the tubing to pass through the longitudinal opening which defines the vertical run of the coil tubing injector unit. Additional objects, features and advantages will be apparent in the written description which follows.

DETAILED DESCRIPTION OF THE INVENTION

Figure 1:
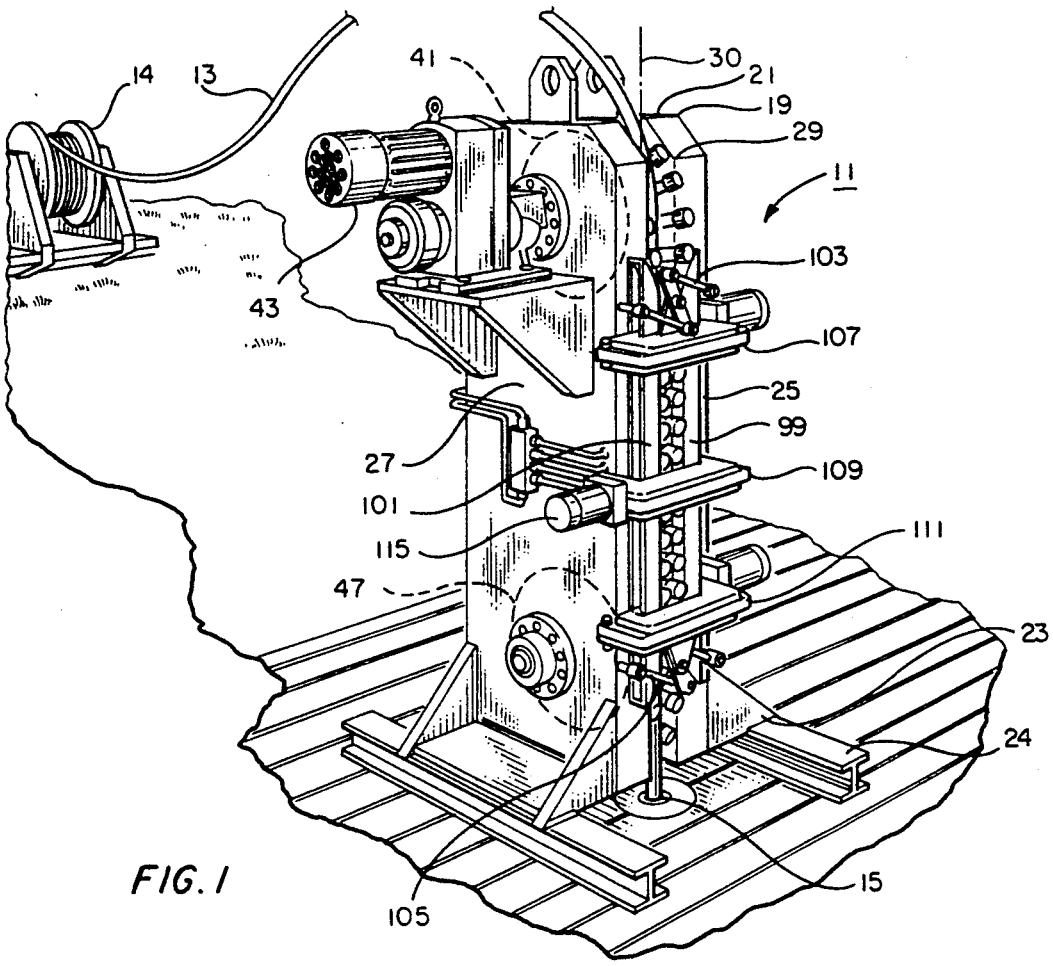
FIG. 1 is a perspective view of a coil tubing injector unit of the invention showing a length of coil tubing being fed from a collection reel into well bore.
Figure 9:
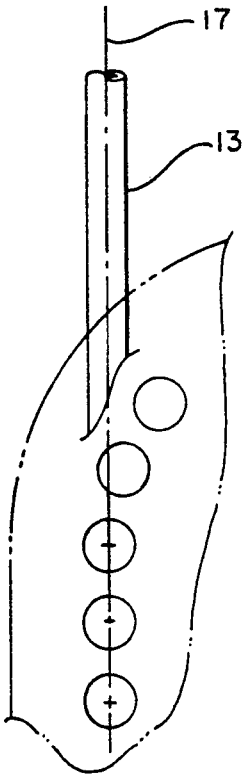
FIG. 9 is a schematic view of the chain drive and vertical run of the injector unit illustrating the alignment of the central vertical axis of the injector unit with the vertical axis of the well bore.

FIG. 1 shows a coil tubing injector unit of the invention designated generally as 11. The injector unit 11 is used for injecting a continuous length of coil tubing 13, as from a take-up reel 14, into a well bore 15 having a vertical well axis (17 in FIG. 9).

A main injector frame 19 is positionable adjacent the well bore 15 and has a top 21, a bottom or base 23 mounted on rails 24, and opposing vertical sides 25, 27. The opposing vertical sides 25, 27 have a longitudinal opening 29 formed therein which defines a vertical run for the injector unit 11. The vertical run defines a central vertical axis 30 for the injector unit 11 which is alignable with the well bore vertical axis (17 in FIG. 9).

Figure 2:
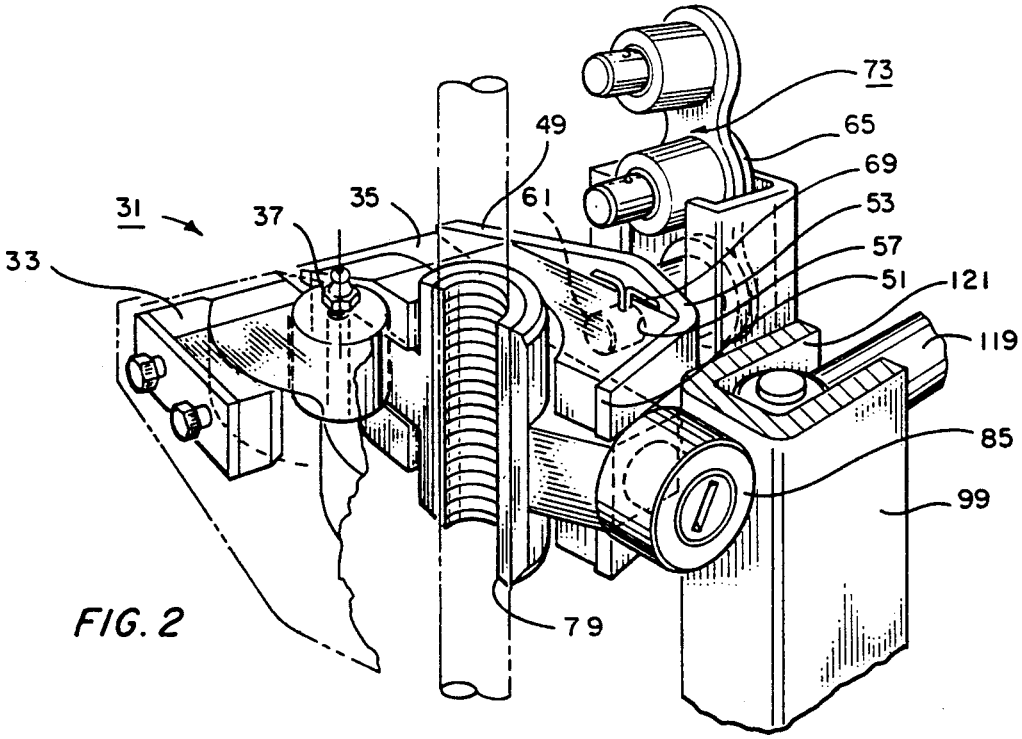
FIG. 2 is a partial, isolated view of a plier-like half of one of the gripper block assemblies used in the injector unit of FIG. 1.
Figure 4:
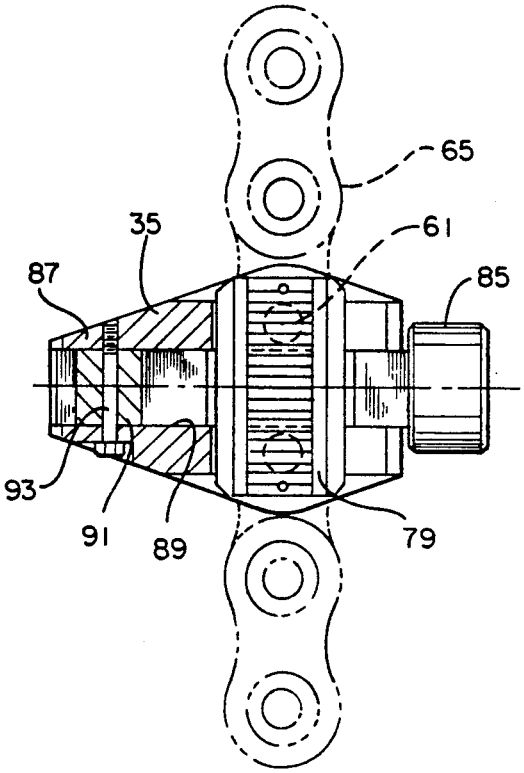
FIG. 4 is a view of one plier-like half of one of the gripper block assemblies of FIG. 3 showing its engagement with the chain drive of the injector unit.
Figure 3:
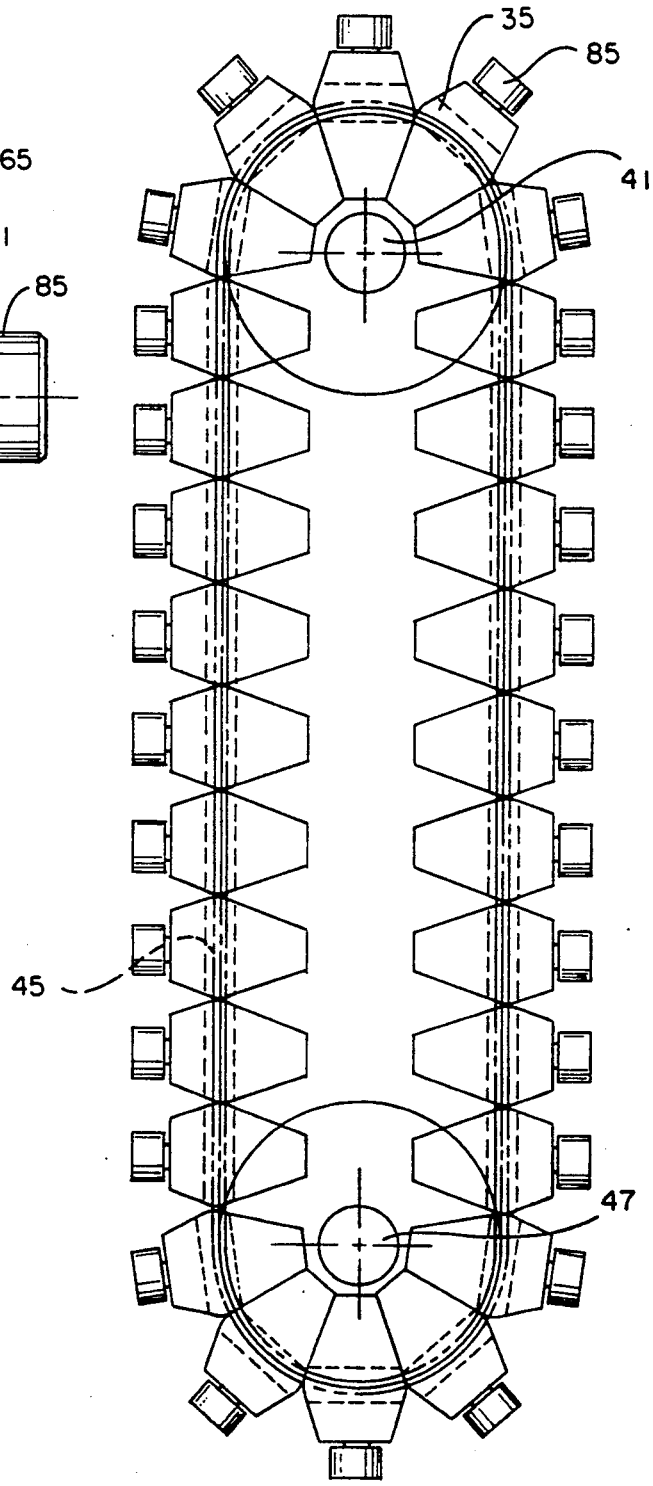
FIG. 3 is an isolated, side view of the chain drive which is used to drive the gripper block assemblies of the injector unit.

As shown in FIGS. 2–4, a plurality of gripper block assemblies 31 are carried on the main injector frame 19. Each of the gripper block assemblies 31 includes a pair of plier-like halves 33, 35 which are joined at the rear at a pivot point 37. As will be explained further with reference to FIGS. 5*a* and 5*b*, the plier-like halves 33, 35 are pivotable between an open position (FIG. 5*b*) and a closed, gripping position (FIG. 5*a*) as the assemblies 31 enter the vertical run 29, whereby the plier halves 33, 35 grip a selected length of tubing (39 in FIG. 5*a*) fed into the main injector frame 19 along the central vertical axis 30 of the injector unit 11 in order to inject the tubing 13 into the well bore.

Drive means, located on the main injector frame 19, drive the gripper block assemblies 31 within the main injector frame. Preferably, the drive means is a chain drive which includes a drive sprocket (illustrated by dotted lines as 41 in FIG. 1) which is driven by a hydraulic motor 43 in conventional fashion. The drive sprocket 41 has an associated chain 45 (FIG. 3) and the gripper block assemblies 31 are carried on the chain as the chain moves in a continuous loop between the drive sprocket 41 and an idler sprocket 47 mounted within the main injector frame.

As shown in FIG. 2, each pair of plier-like halves 33, 35 of each gripper block assembly 31 is carried within a rigid bucket 49 having a front opening 51. At least one of the opposing sides 53, 55 and preferably both sides are provided with apertures 57, 59 for receiving the lug 61, 63 of an associated chain link 65, 67 of the drive chain. The lugs 61, 63 are retained within the apertures 57, 59 provided within the buckets by cotter pins 69.

Figure 5A:
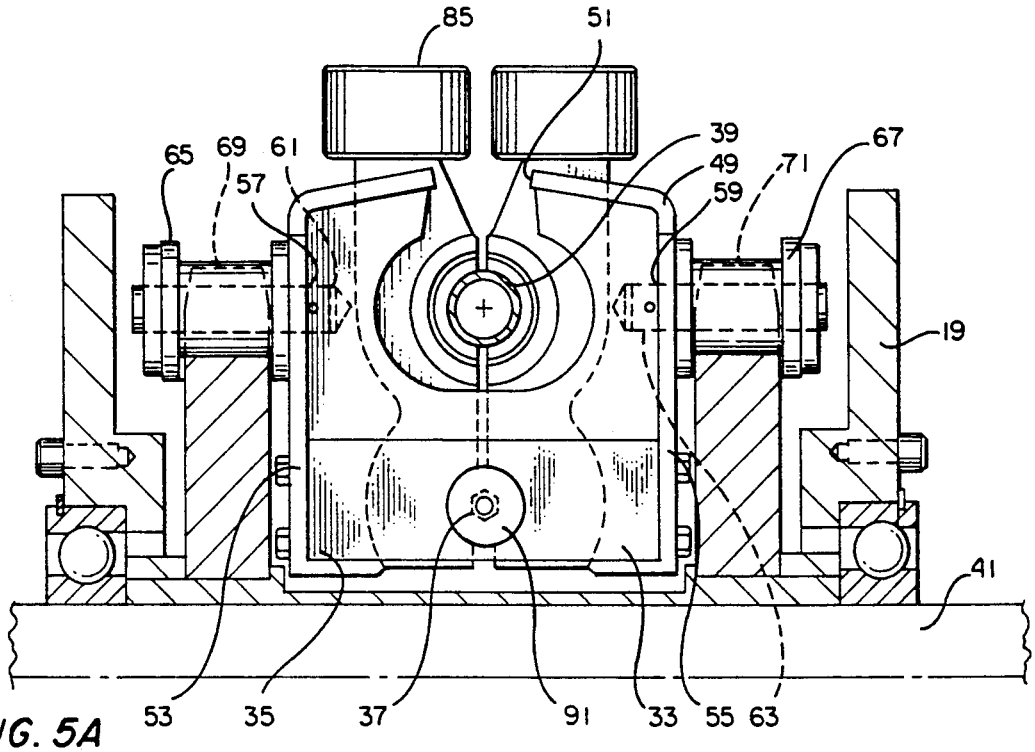
FIG. 5*a* is a top view of a gripper block assembly showing the assembly entering the vertical run of the injector unit with the gripper block assemblies in the closed, gripping position.

As best seen in FIG. 5*a*, the drive sprocket 41 includes teeth 69, 71 which engage selected openings 73 provided by the links 65 of the chain 45 for driving the chain 45 within the main injector frame 19. As best shown in FIG. 3, the chain drive carries twenty-eight buckets 49, each bucket having an associated pair of plier-like halves, as it travels in a continuous loop between the drive sprocket 41 and the idler sprocket 47 within the main injector frame.

Figure 5B:
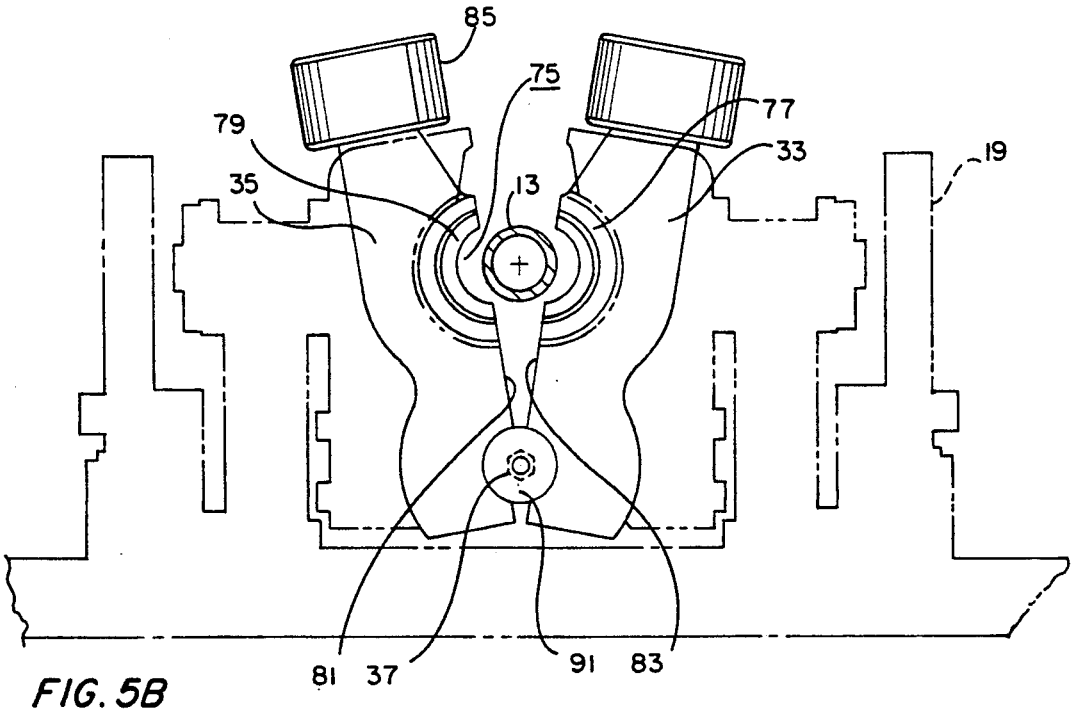
FIG. 5*b* is a view similar to 5*a* showing the gripper block assemblies in the open position prior to entering the vertical run of the injector unit.

As seen in FIGS. 5*a* and 5*b*, the gripper block halves 33, 35 together form a jaw opening 75 of predetermined size for gripping a selected length of coil tubing. Each of the plier halves 33, 35 preferably includes a replaceable insert 77, 79 which forms a semi-circular recess within the respective face 81, 83 of each plier-like half. The replaceable inserts are preferably formed of a softer material than the remainder of the gripper block assembly, for instance brass or aluminum. By changing the replaceable insert 77, 79, the size of the jaw opening 75 can be varied, whereby a variety of diameters of coil tubing can be injected into the well bore. Also, the replaceable inserts receive the greatest wear during use and can be replaced more economically than the entire gripper block assembly.

As shown in FIG. 4, each plier-like half 35 includes a front roller bearing 85 and a tapered rear surface 87. An internal channel 89 receives one side of a cylindrically shaped mounting member 91 which forms a rear pivot point for the plier-like halves 33, 35 and which includes a bolt 93 for securing the member 91 and the plier-like halves within the respective bucket 49.

Figure 6:
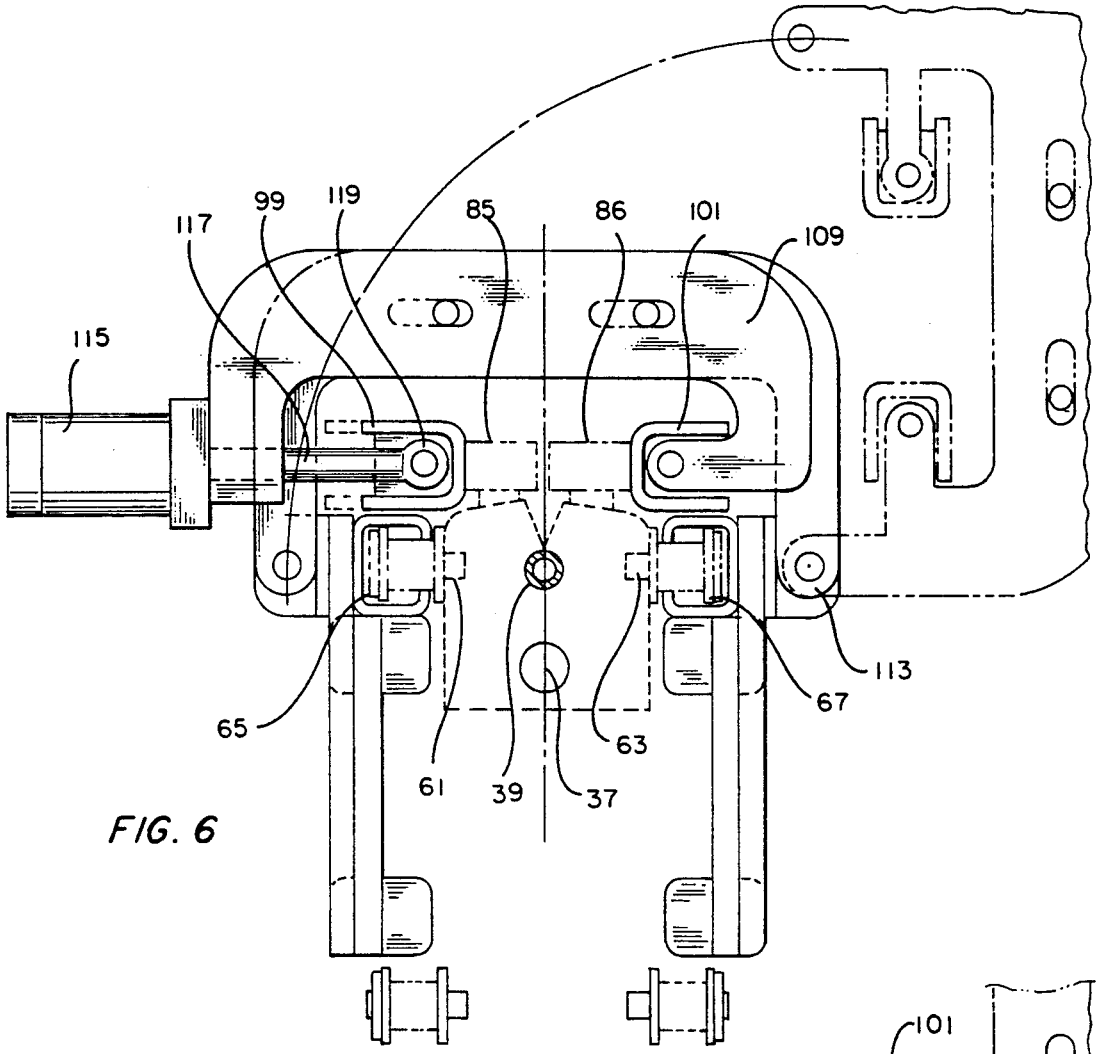
FIG. 6 is a top view of the injector unit showing the C-shaped clamps of the clamping assembly being pivoted between the disengaged and engaged position with respect to the coil tubing being fed within the vertical run of the injector unit.
Figure 7:
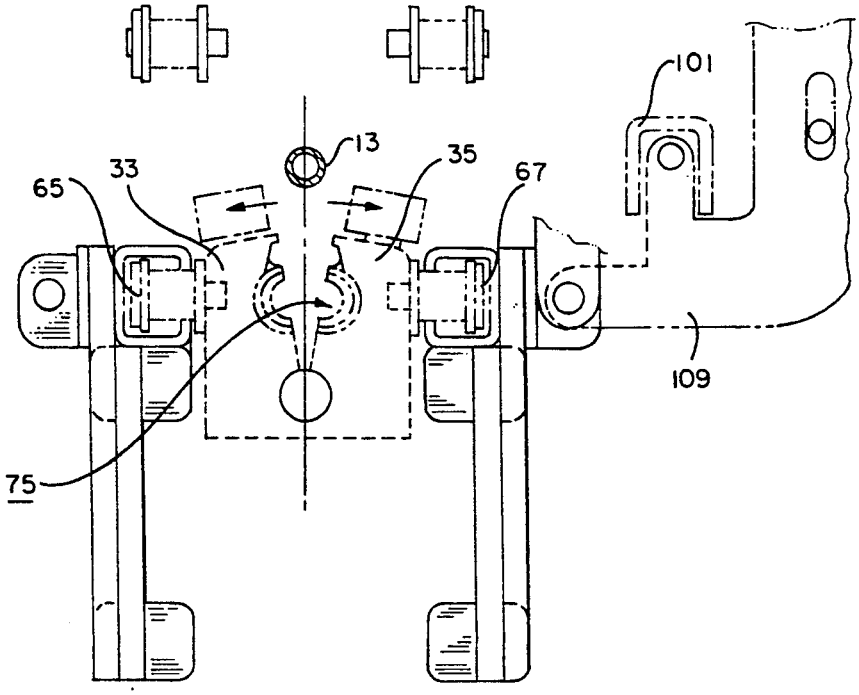
FIG. 7 is a view similar to FIG. 6 showing the C-shaped clamps being pivoted to the open position, thereby allowing the plier-like halves of the gripper block assemblies to move to the open position.

As shown in FIGS. 1 and 6–7, the injector unit 11 also includes a clamping assembly including first and second vertical rails 99, 101 which are spaced a selected distance within the clamping assembly for frictionally engaging the gripper block assemblies 31. The clamping assembly also includes a plurality of C-shaped clamps 107, 109, 111, each of which is pivotally mounted at one extent 113 (FIG. 6) whereby the C-shaped clamps are pivotable between the disengaged and engaged positions. By moving the C-shaped clamps to the engaged position, the vertical rails 99, 101 are caused to contact the roller bearings 85, 86 of the gripper block assemblies to pivot the gripper blocks to the closed, gripping position illustrated in FIG. 6. Preferably, the vertical rails 99, 101 are connected to scissor mechanisms 103, 105 at the upper and lower extents thereof for varying the space between the vertical rails.

As illustrated in FIGS. 6 and 7, the C-clamps 107, 109, 111 can be pivoted to the disengaged position shown in FIG. 7, whereby the jaw opening 75 of the gripper block assemblies can be widened to allow the main injector frame 19 to be moved in a transverse direction with respect to the well bore vertical axis 17, as by sliding the unit in a direction transverse to the well vertical axis. In this way, a selected length of coil tubing 13 being fed within the well bore 15 is allowed to pass through the longitudinal opening 29 which defines the vertical run of the coil tubing unit. This allows the injector unit 11 to be removed from the string of coil tubing, should problems occur during a well workover operation. It is not necessary to separate the continuous length of tubing, as was necessary in the past with opposing chain drive systems.

The clamping assembly also includes adjustment means, such as hydraulic cylinders 115 (FIG. 6) each of which includes an output shaft 117 having an outer extent 119 which is received within the U-shaped opening (121 in FIG. 2) of a respective vertical rail 99. In this way, a selected one of the cylinder and output shaft are operatively engaged with at least one of the vertical rails 99 of the clamping assembly for varying the distance between the rails. Thus, as the output shaft (117 in FIG. 6) moves to the extended position, the scissor mechanisms 103, 105 move the vertical rails closer together. As the output shaft 117 is moved to the retracted position, the scissor mechanisms allow the vertical rails to separate to a greater distance. By varying the distance between the vertical rails 99, 101, it is possible to vary the degree of frictional engagement of the gripper block assemblies 31 on the length of coil tubing 13 being injected into the well bore 15.

Figure 8:
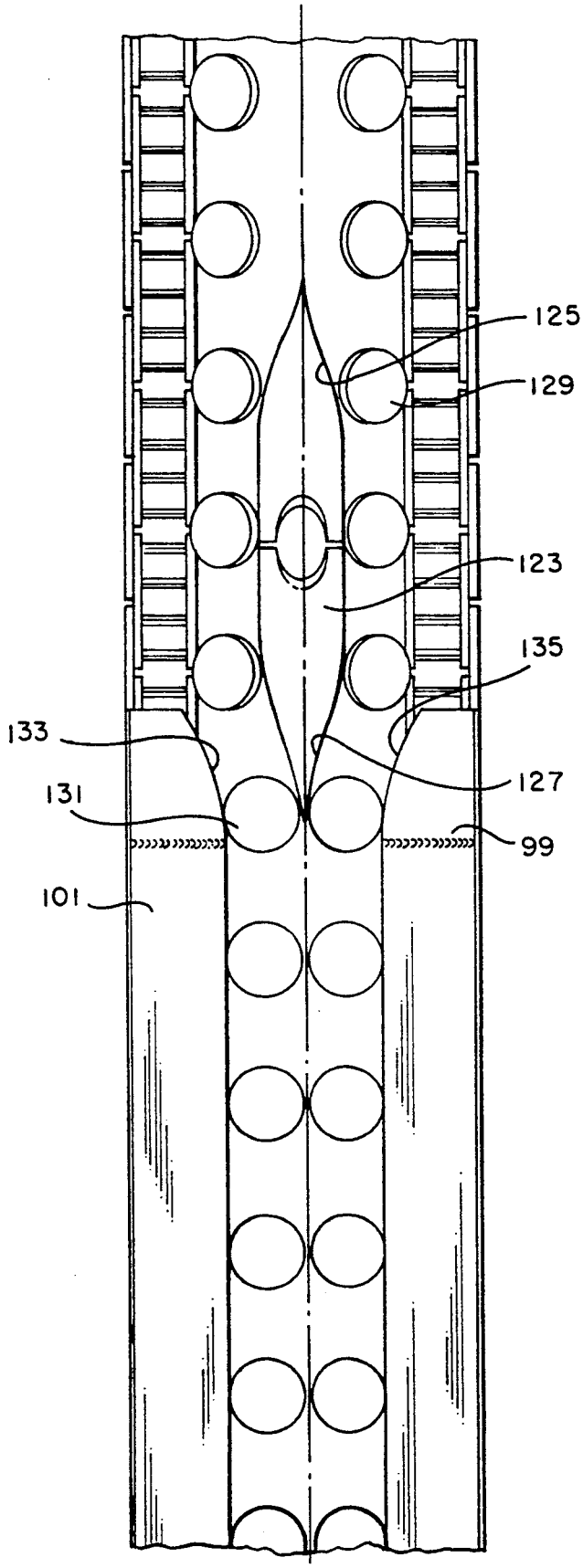
FIG. 8 is a top, plan view of a portion of the drive chain and gripper block assemblies of the injector unit of FIG. 1 showing the spreader plate which pivots the plier-like halves of the gripper block assemblies to the open position prior to entering the vertical run.

As shown in FIG. 8, the main injector frame 19 preferably includes a fixed spreader plate 123 having tapered upper and lower extents 125, 127, respectively. The spreader plate 123 is located within the longitudinal opening 29 of the main frame 13 in alignment with the vertical run for pivoting the plier-like halves of the gripper block assemblies 31 to the open position illustrated at 129 in FIG. 8 prior to entering the clamping assembly. As the gripper block assemblies 31 enter the vertical rails 99, 101, the plier-like halves 33, 35 move to the closed position, illustrated at 131 in FIG. 8.

In the method for injecting coil tubing using the device of the invention, the main injector frame 19 is positioned adjacent the well bore 15 with the central vertical axis 30 thereof aligned with the well bore vertical axis 17 and a continuous length of tubing is fed along the central vertical axis. The hydraulic motor 43 is then actuated to turn the drive sprocket 41 and the chain drive, thereby causing the gripper block assemblies 31 to travel in a continuous loop within the main frame between the drive sprocket 41 and the idler sprocket 47. As the gripper block assemblies enter the vertical run and contact the upper tapered surfaces 133, 135 (FIG. 8) of the vertical rails, the plier-like halves 33, 35 are moved to the closed position, causing the replaceable inserts 77, 79 to frictionally engage the tubing 13 at a selected location. In this way, a selected length of tubing 13 is fed into the main injector frame 19 along the central vertical axis 30 and is injected into the well bore.

The hydraulic cylinders 115 on the clamping mechanism can be selectively actuated in order to vary the distance between the vertical rails 99, 101 and thereby vary the compressive force exerted by the gripper block assemblies on the length of tubing. Using the device of the invention, 1 to 2 inch diameter tubing can be fed into the well bore at a rate on the order of 250–300 feet per minute.

If a problem occurs during well workover operations, the device of the invention can be easily removed from the coil tubing string. The C-shaped clamps 107, 109 are first pivoted about their pivot points 113 to the open position shown in FIG. 7 and the plier-like halves of the gripper block assembly are spread to the open position. The injector unit can then be removed from the coil tubing by sliding the unit in a direction transverse to the vertical well axis.

An invention has been provided with several advantages. The coil tubing injector unit of the invention is simpler in design and more economical to manufacture than were the prior art designs. Because opposing drive chains are not utilized, the present device requires only about forty percent of the moving parts of the prior art devices. Because the coil tubing injector unit features an open-faced design, it allows the unit to be removed from a continuous length of tubing if problems occur during operations. The device is capable of handling larger tubing diameters, on the order of two inches or more. The replaceable inserts utilized in the gripper block assemblies allow the device to be easily refitted in the field to accommodate different diameter tubing being injected. The replaceable inserts are also more economical to replace than were the prior art, single piece grippers used in the opposing drive systems.

While the invention has been shown in only one of its forms, it is not thus limited but is susceptible to various changes and modifications without departing from the spirit thereof.

What is claimed is:

1. A coil tubing injector unit for injecting tubing into a well bore having a vertical well axis, the coil tubing injector unit comprising:

a main injector frame positionable adjacent the well bore, the main injector frame having a top, a bottom and opposing vertical sides, a selected one of the opposing vertical sides having a longitudinal opening formed therein which defines a vertical run for the injector unit, the vertical run defining a central vertical axis for the injector unit which is alignable with the well bore vertical axis;

a plurality of gripper block assemblies carried on the main injector frame, each of the gripper block assemblies including a pair of plier-like halves which are pivotable between an open position and a closed, gripping position as the assemblies enter the vertical run, whereby the plier halves grip a selected length of tubing fed into the main injector frame along the central vertical axis of the injector unit in order to inject the tubing into the well bore; and drive means located on the main injector frame for driving the gripper block assemblies within the main injector frame.

2. The coil tubing injector unit of claim 1, wherein the drive means is a chain drive including a drive sprocket and an associated chain, the gripper block assemblies being carried on the chain as the chain moves in a continuous loop about the drive sprocket.

3. The coil tubing unit of claim 2, wherein the vertical run defines an open face for the coil tubing injector unit, the open face allowing a selected length of vertically oriented coil tubing being fed along the well vertical axis to pass through the vertical run by moving the main injector frame in a direction transverse to the well vertical axis when the gripper block assemblies are in the open position.

4. The coil tubing unit of claim 3, wherein the plier-like halves of the gripper block assemblies together form a jaw opening of predetermined size for gripping a selected length of coil tubing, each of the plier-like halves including a replaceable insert for varying the size of the jaw opening, whereby a variety of sizes of coil tubing can be injected into the well bore by interchanging the replaceable inserts.

5. A coil tubing injector unit for injecting tubing into a well bore having a vertical well axis, the coil tubing injector unit comprising:

a main injector frame positionable adjacent the well bore, the main injector frame having a top, a bottom and opposing vertical sides, a selected one of the opposing vertical sides having a longitudinal opening formed therein which defines a vertical run for the injector unit, the vertical run defining a central vertical axis for the injector unit which is alignable with the well bore vertical axis;

a chain drive located on the main injector frame having a drive sprocket at a first vertical elevation on the main injector frame and having a cooperating sprocket located at a second, lower vertical elevation on the main injector frame, the chain drive having an associated chain which is driven in a continuous loop between the drive and cooperating sprockets;

a plurality of gripper block assemblies carried by the chain drive, each of the gripper block assemblies including a pair of plier-like halves which are pivotable between an open position and a closed, gripping position as the chain drive enters the vertical run, whereby the plier halves grip a selected length of tubing fed into the main injector frame along the central vertical axis of the injector unit in order to inject the tubing into the well bore.

6. A coil tubing injector unit for injecting tubing into a well bore having a vertical well axis, the coil tubing injector unit comprising:

a main injector frame positionable adjacent the well bore, the main injector frame having a top, a bottom and opposing vertical sides, a selected one of the opposing vertical sides having a longitudinal opening formed therein which defines a vertical run for the injector unit, the vertical run defining a central vertical axis for the injector unit which is alignable with the well bore vertical axis;

a chain drive located on the main injector frame having a drive sprocket at a first vertical elevation on the main injector frame and having an idler sprocket located at a second, lower vertical elevation on the main injector frame, the chain drive having an associated chain which is driven in a continuous loop between the drive and cooperating idler sprockets;

a plurality of gripper block assemblies carried by the chain drive, each of the gripper block assemblies including a pair of plier-like halves which are pivotable between an open position and a closed, gripping position as the chain drive enters the vertical run, whereby the plier halves grip a selected length of tubing fed into the main injector frame along the central vertical axis of the injector unit in order to inject the tubing into the well bore; and a clamping assembly mounted on the main injector frame, the clamping assembly including first and second vertical rails spaced a selected distance within the clamping assembly for frictionally engaging the gripper block assemblies, the clamping assembly also including at least one C-shaped clamp movable between a disengaged position with respect to the coil tubing being fed within the vertical run and an engaged position in which the vertical rails are urged to contact the plier-like halves of the gripper block assemblies to pivot the gripper blocks to the closed, gripping position.

7. The coil tubing injector unit of claim 6, wherein the clamping assembly further comprises adjustment means for varying the distance between the vertical rails to vary the degree of frictional engagement of the gripper block assemblies on the length of coil tubing being injected into the well bore.

8. The coil tubing injector unit of claim 7, wherein the adjustment means comprises at least one hydraulic cylinder having an output shaft, a selected one of the cylinder and output shaft being operatively engaged between the frame and at least one of the vertical rails of the clamping assembly for varying the distance between the vertical rails.

9. The method of claim 8, further comprising a spreader plate located on the main injector frame in alignment with the vertical run for pivoting the plier-like halves of the gripper block assemblies to the open position prior to entering the vertical run.

10. A method for injecting coil tubing into a well bore having a vertical well axis, the method comprising the steps of:

positioning a main injector frame adjacent the well bore, the main injector frame being provided with a top, a bottom and opposing vertical sides, a selected one of the opposing vertical sides being provided with a longitudinal opening formed therein which defines a vertical run for the injector unit, the vertical run defining a central vertical axis for the injector unit which is alignable with the well bore vertical axis;

providing a plurality of gripper block assemblies carried on the main injector frame, each of the gripper block assemblies including a pair of plier-like halves which are pivotable between an open position and a closed, gripping position as the assemblies enter the vertical run, whereby the plier halves grip a selected length of tubing fed into the main injector frame along the central vertical axis of the injector unit in order to inject the tubing into the well bore;

feeding a continuous length of coil tubing from a take-up reel along the central vertical axis of the injector unit; and driving the gripper block assemblies within the main injector frame to inject the coil tubing within the well bore.

11. The method of claim 10, wherein the coil tubing injector unit is further provided with clamping means pivotally mounted on the main injector frame, the clamping means including first and second vertical rails spaced a selected distance within the clamping means for frictionally engaging the gripper block assemblies, the clamping means also including at least one C-shaped clamp which is pivotable between a disengaged position with respect to the coil tubing being fed within the vertical run and an engaged position in which the vertical rails contact the plier-like halves of the gripper block assemblies to pivot the gripper blocks to the closed, gripping position; and wherein the at least one C-shaped clamp is pivoted to the engaged position to engage the gripper block assemblies in the closed, gripping positions on the coiled tubing being fed into the well bore.

12. The method of claim 11, further comprising the steps of pivoting the at least one C-shaped clamp to the disengaged position and moving the plier-like halves of the gripper block assemblies to the open position; and removing the coil tubing injection unit by sliding the unit in a direction transverse to the well vertical axis, whereby the selected length of coil tubing being fed within the well bore passes through the longitudinal opening which defines the vertical run of the coiled tubing injector unit.

* * * * *